US006063216A

United States Patent [19]

Damm et al.

[11] Patent Number: 6,063,216

[45] Date of Patent: May 16, 2000

[54] WORKING OF A METALLIC STRIP

[75] Inventors: Oliver F. R. A. Damm, Pretoria, South Africa; Warwick John Green, Penetanguishane, Canada; Lillian Hristov Ivanchev, Germiston, South Africa; Walter Luigi Trevisan, Johannesburg, South Africa

[73] Assignee: Trico Products Corporation, Buffalo, N.Y.

[21] Appl. No.: 09/134,561

[22] Filed: Aug. 14, 1998

[30] Foreign Application Priority Data

Aug. 15, 1997 [ZA] South Africa ..... 97/7365

[51] Int. Cl.[7] ..... C21D 8/02; C21D 9/84

[52] U.S. Cl. ..... 148/645; 148/646; 148/648; 148/320; 266/249; 266/254

[58] Field of Search ..... 148/645, 646, 148/648, 320; 266/249, 259

[56] References Cited

U.S. PATENT DOCUMENTS 3,857,741 12/1974 Hultgren et al. ..... 148/36

5,875,672 3/1999 Fourie et asl. ..... 72/240

*Primary Examiner*—Daniel J. Jenkins

*Assistant Examiner*—Nicole Coy

*Attorney, Agent, or Firm*—Nixon & Vanderhye PC

[57] ABSTRACT

This invention relates to the working of a metallic strip. More particularly, the invention relates to a method of working a length of metallic strip by heat treating under tensile force, to a length of metallic strip and to an apparatus for use in working a length of metallic strip.

15 Claims, 2 Drawing Sheets

WORKING OF A METALLIC STRIP

SUMMARY OF INVENTION

This invention relates to the working of a metallic strip. More particularly, the invention relates to a method of working a length of metallic strip, to a length of metallic strip and to an apparatus for use in working a length of metallic strip.

According to a first aspect of the invention, there is provided a method of working a length of metallic strip, which includes the steps of positioning the strip on a former; and forming the strip on the former into a predetermined shape while subjecting it to a heat treatment process.

The method may include the step of applying a tensile force to each end of the strip after positioning the strip on the former, thereby causing the strip to seat snugly on the former and restricting the strip to the predetermined shape. The force may be applied for the duration of the heat treatment process.

The magnitude of the force may be adjustable in order to accommodate expansion and shrinkage of the strip in the heat treatment process. The force may be adjusted so as not to exceed the yield point of the thinnest sections of the strip at any time during the working of the strip.

The former may have a convex upper surface and the strip may be positioned on the surface with its ends projecting beyond ends of the upper surface with the tensile force being applied to said projecting ends.

The force may applied by pneumatic means, by suspending a weight coupled to a spring to each of the ends of the strip, or the like.

The step of forming the strip into the predetermined shape while subjecting it to a heat treatment process may be controlled by a processor.

The step of positioning the strip may include locating the strip on the former such that a locating means of the strip corresponds with complementary locating formations on the former.

The method may include controlling oxidation of the strip by conducting the heat treatment process in a neutral atmosphere, such as a nitrogen atmosphere.

The heat treatment process may include a first heating step in which the strip is rapidly heated to a temperature above a transformation temperature, In the case where the metallic strip is formed of a ferrous material, this step may include heating of the strip to above its an austenite transformation temperature. The strip may be heated to a temperature of between about 900° C. and 1100° C., more particularly to a temperature of about 1050° C.

The method may further include the step of quenching the strip after the first heating step whilst it is on the former. The strip may be quenched in a controlled cooling process to a temperature required to form martensite.

The strip may be subjected to at least one further heating step for stress relief tempering or ageing, or the like, with the further step or steps being conducted at a lower temperature than the transformation temperature. It will be appreciated that in the case of the metallic strip comprising a ferrous material, each of the further heating steps is conducted at a lower temperature than the austenite transformation temperature. One of the heating steps may comprise a tempering step, in which the strip is heating and cooled to form tempered martensite. Thus, the strip may be heated to a temperature of between 400° C. and 700° C., and preferably to a temperature of between 500° C. and 600° C. It will be appreciated that the temperature to which the strip is heated is determined by the steel grade, the heating rate of the strip and degree of hardness required. The strip may then be allowed to cool.

Heating of the strip in all the steps of the heat treatment process may be done by means of induction heating, gas heating, heating in a radiant heat furnace or by a radiant heat, or the like.

Cooling of the strip in all of the heat treatment process steps may be by means of a fine water spray, air, or with a solution containing a polymer, or the like.

According to a second aspect of the invention there is provided a length of worked metallic strip which is substantially residually stress free and which is produced by the method as described above.

The worked strip may have a thickness which varies along its length in a ratio of at least 2:1, with its ends being the thinnest sections of the strip. In a preferred embodiment, the thickness of the strip may vary in a ratio of 2,7:1.

The width of the strip may also vary along its length, so that each strip tapers inwardly, uniformly and continuously in both thickness and width from its centre to its ends.

The worked strip may comprise a support beam for a windscreen wiper blade assembly.

The worked strip may have a hardness of between 30 HRC and 60 HRC and a yield strength of between 650 MPa and 220 MPa.

According to a third aspect of the invention, there is provided an apparatus for use in working a length of metallic strip which includes a former for forming the strip into a predetermined shape in accordance with the method as described above.

The former may be manufactured from a material having a low thermal expansion co-efficient and a low heat conductivity, such as a ceramic material.

The former may have an elongate, convex shaped, upper surface. The upper surface of the former may taper inwardly, uniformly and continuously in width from its centre to its ends.

The apparatus may also include a restricting means for restricting the strip in position on the former.

The invention is now described by way of example with reference to the accompanying diagrammatic drawings.

DETAILED DESCRIPTION

Figure 1:
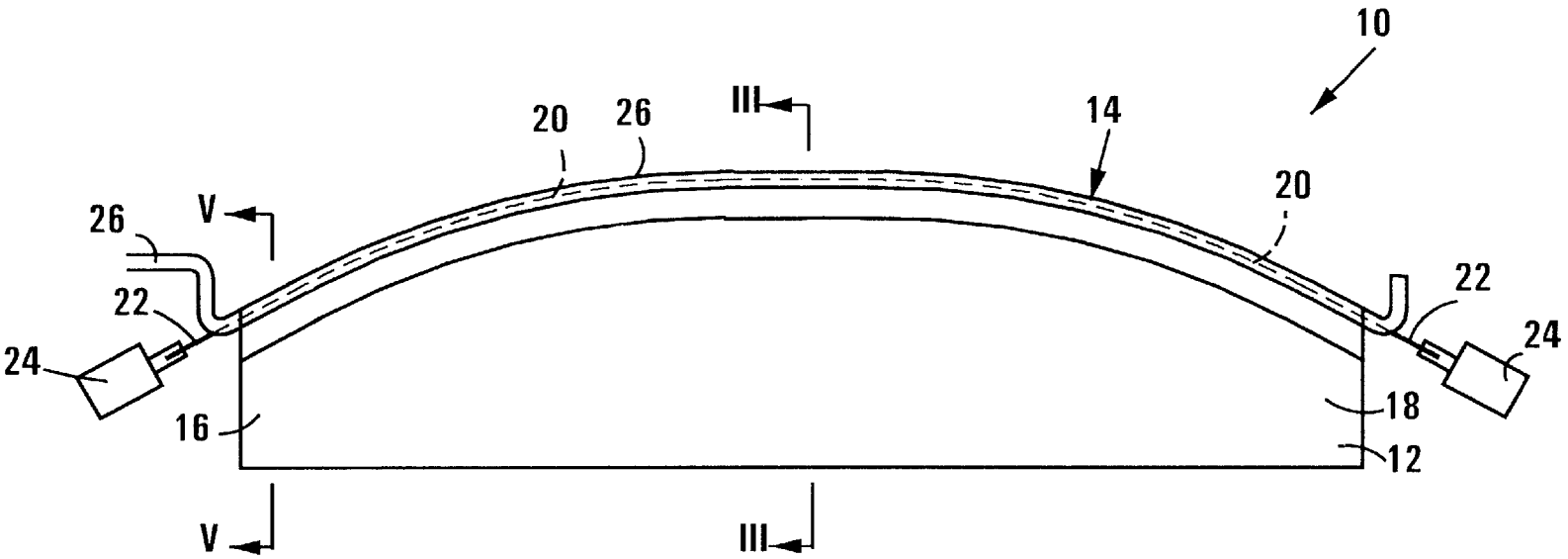
FIG. 1 shows a schematic side view of apparatus for use in working a length of metallic strip, in accordance with one aspect of the invention.

Referring to the drawings, apparatus in accordance with the invention, for use in working a length of metallic strip, is designated generally by the reference number 10.

Figure 2:
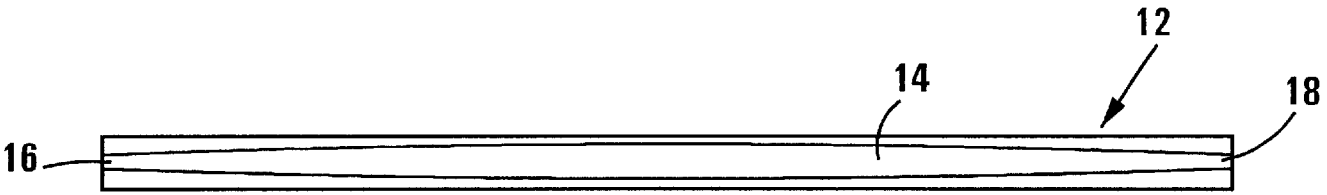
FIG. 2 shows a schematic plan view of a former forming part of the apparatus of FIG. 1.
Figure 3:
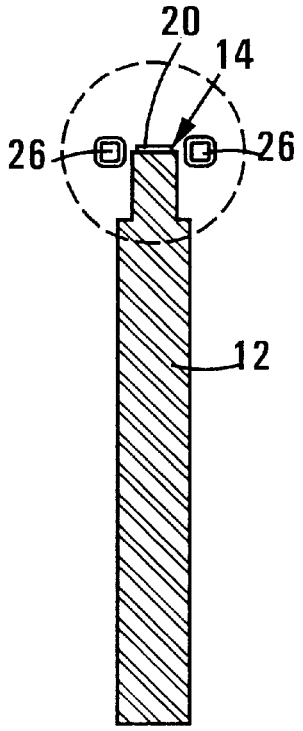
FIG. 3 shows a sectional end view of the apparatus taken along line III—III in FIG. 1.
Figure 4:
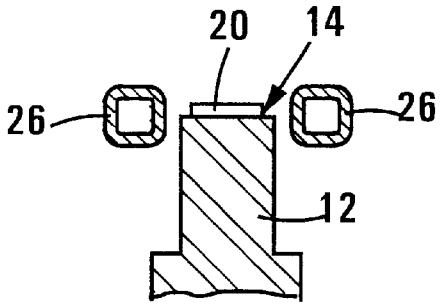
FIG. 4 shows an enlarged schematic view of the encircled part of FIG. 3; end
Figure 5:
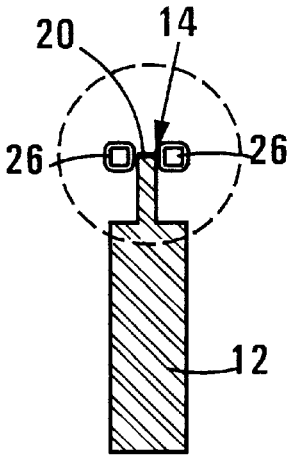
FIG. 5 shows a sectional end view of the apparatus taken along line V—V in FIG. 1.
Figure 6:
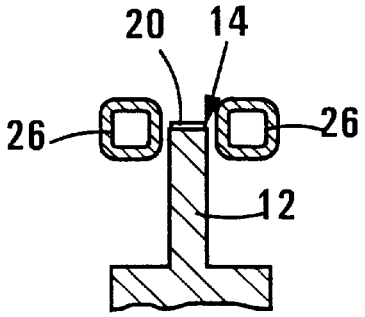
FIG. 6 shows an enlarged schematic view of the encircled part of FIG. 5.

The apparatus 10 includes a former 12 of a ceramic material. The former 12 has an elongate, convex shaped upper surface 14, which tapers inwardly, uniformly and continuously in width from its centre to its ends 16 and 18. The variation in width of the upper surface 14 of the former 12 is clearly illustrated in FIG. 2 of the drawings.

A length of metallic strip 20 is located on the former 12, with ends 22 extending beyond the ends 16 and 18 of the former 12. The apparatus 10 further includes a pair of pneumatic cylinders 24, with a cylinder 24 being connected to each end 22 of the strip 20.

As illustrated in FIGS. 3 to 6, the thickness and width of the strip 20 also varies along its length, so that each strip 20 tapers inwardly, uniformly and continuously in both thickness and width from its centre to its end 22.

The dimensions of the strip are as follows:

length=450 mm (plus an additional predetermined length of strip at each end, which is used for attachment to the hydraulic cylinders. The additional lengths are cut off after treatment of the strip)

thickness at the centre=1.29 mm thickness at the ends=0.30 mm width at the centre=11 mm; and width at the ends=6 mm The apparatus 10 also includes a pair of induction coil heating elements 26 which are located proximate the upper surface 14 of the former 12.

In use, the metallic strip 20 is located on the upper surface 14 of the former 12. Each of the ends 22 of the strip 20, is attached to one of the pneumatic cylinders 24. The strip 20 is then cold formed on the former 12 by exerting a tensile force on the ends 22, causing the strip 20 to seat snugly on the upper surface 14 and thereby forming a substantially curved strip 20. The force is maintained at just below the yield point of the thinnest sections of the strip and is in the region of about 80N. The strip 20 is restricted in this position and subjected to a heat treatment process.

The strip 20 is rapidly heated by the elements 26 to a temperature of about 1050° C., thus overshooting the austenite transformation temperature. The strip 12 is quenched by means of a fine water spray to a temperature required to form martensite. Within 0.5–2 seconds after initiating the quenching of the strip, the tensile force is gradually increased to between 250 N and 450 N.

The strip 20 is then tempered by heating the strip to a temperature of about 400° C. for a period of about 5 seconds to from temper martensite. The strip 20 is allowed to cool and is removed from the former 12. During the tempering step, the tensile force is maintained at between about 250 to 500 N, and more particularly between 250 N and 300 N.

The applicant believes that one of the advantages of the invention is that the method combines the shaping and heat treatment of a product in a single step, thereby eliminating the need to shape the product after a heat treatment process, which creates further stresses. It is clear that the combination of forming and subjecting the strip to a heat treatment process determines the final shape and mechanical properties such as hardness, strength, toughness, and the like. In addition, the fact that the strip is subjected to a tensile force for at least a part of the heat treatment process, such as the tempering step, assists in forming a substantially residually stress free product.

What is claimed is:

1. A method of working a length of metallic strip, for a support beam for a windscreen wiper blade which includes the steps of positioning the strip on a former; and heating the strip while subjecting the strip to tensile force to shape the strip to a predetermined shape.

2. The method as claimed in claim 1 wherein the positioning causes the strip to seat snugly on the former and restricts the strip to the predetermined shape.

3. The method as claimed in claim 2, in which the force is applied for the duration of the heating.

4. The method as claimed in claim 2, in which the magnitude of the force is adjustable in order to accommodate expansion and shrinkage of the strip during heating.

5. The method as claimed in claim 2, in which the former has a convex upper surface and the strip is positioned on the surface with its ends projecting beyond ends of the upper surface with the tensile force being applied to said projecting ends.

6. The method as claimed in claim 2, in which the tensile force is applied by pneumatic means.

7. The method as claimed in claim 1, in which the heat treatment process includes a first heating step in which the strip is rapidly heated to a temperature above transformation temperature.

8. The method as claimed in claim 7, which includes the step of quenching the strip after the first heating step whilst it is on the former.

9. The method as claimed in claim 7, in which the strip is subjected to at least one further heating step for stress relief, tempering or ageing, with the further step or steps being conducted at a lower temperature than the transformation temperature.

10. A length of worked metallic strip which is substantially residually stress free and which is produced by the method as described in any one of claims 1 to 9.

11. The worked strip as claimed in claim 10, which comprises a support beem for a windscreen wiper blade assembly.

12. The worked strip as claimed in claim 10, which has a yield strength of between 650 MPa and 220 MPa.

13. An apparatus for use in working a length of metallic strip which includes a former for forming the strip into a predetermined shape in accordance with the method as claimed in any one of claims 1 to 9.

14. The apparatus as claimed in claim 13, in which the former has an elongate, convex shaped, upper surface.

15. The apparatus as claimed in claim 13, which includes a restricting means for restricting the strip in position on the former.

* * * * *